US005561260A

United States Patent [19]

Towning et al.

[11] Patent Number: 5,561,260

[45] Date of Patent: Oct. 1, 1996

[54] PROPELLED PYROTECHNIC DECOY FLARE

[75] Inventors: James N. Towning, Tunbridge; Timothy D. Sutlieff, Horsham; Peter G. Pelham, Sevenoaks, all of England

[73] Assignee: The Secretary of State for Defence in Her Britannic Majesty's Government of the United Kingdom of Great Britain and Northern Ireland, Whitehall, United Kingdom

[21] Appl. No.: 941,871

[22] Filed: Sep. 11, 1992

[30] Foreign Application Priority Data

Oct. 1, 1991 [GB] United Kingdom ..... 9120801

[51] Int. Cl.[6] ..... F42B 4/26

[52] U.S. Cl. ..... 102/336; 149/19.3; 149/116

[58] Field of Search ..... 102/336; 149/19.3, 149/116

[56] References Cited

U.S. PATENT DOCUMENTS

| | | | |
|---|---|---|---|
| 4,276,100 | 6/1981 | Colvin et al. | 149/109.6 |
| 4,463,679 | 8/1984 | Billard | 102/336 |
| 4,624,186 | 11/1986 | Widera et al. | 102/336 |
| 4,698,108 | 10/1987 | Vega et al. | 149/21 |
| 4,881,464 | 11/1989 | Sayles | 102/336 |
| 5,056,435 | 10/1991 | Jones et al. | 102/336 |
| 5,129,323 | 7/1992 | Park | 102/293 |
| 5,136,950 | 8/1992 | Halpin et al. | 102/336 |

FOREIGN PATENT DOCUMENTS

| | | |
|---|---|---|
| 1534919 | 12/1978 | United Kingdom . |
| 2006403 | 5/1979 | United Kingdom . |
| 1577901 | 10/1980 | United Kingdom . |
| 2134228 | 8/1984 | United Kingdom . |

*Primary Examiner*—Peter A. Nelson
*Attorney, Agent, or Firm*—Nixon & Vanderhye P.C.

[57] ABSTRACT

An aircraft launched pyrotechnic decoy flare (1) which comprises a pellet (2) configured with a cavity (4) which extends along a fore-and-aft axis (8) of the pellet (2) and is vented at its rearward end (12). Part of the external surface of the pellet (2) is covered with a casing (16) to prevent combustion of said part of the surface. The pellet (2) is made of a gassy pyrotechnic composition including an organic binder, and an oxidizing halogenated polymer and an oxidizable metallic material which react with each other on ignition and emit infrared radiation. When the flare (1) is ignited the surface of the cavity (4) combusts and produces hot gaseous products which escape from the cavity (4) through the vent (22) thus propelling the flare (1) in a forwards direction. In this way the flare (1) can be propelled in the same direction as the aircraft to reduce the rate at which the flare (1) separates from the aircraft exhaust.

21 Claims, 6 Drawing Sheets

PROPELLED PYROTECHNIC DECOY FLARE

BACKGROUND OF THE INVENTION

1. Field of the Invention

This invention relates to a propelled pyrotechnic decoy flare, and in particular to a decoy flare that can be aircraft-launched to lure incoming missiles with advanced infra-red seeker systems away from the aircraft's exhaust.

2. Discussion of Prior Art

Known decoy flare compositions comprise magnesium and polytetrafluoroethylene (hereafter PTFE) mixtures pressed to form pellets. A pellet is then launched from an aircraft when an incoming missile is detected. The pellet is ignited on launch and burns to produce an infra-red source more intense than the aircraft exhaust. If the incoming missile has an infra-red seeker system then the missile can be lured away from the aircraft exhaust to the more intensely burning pellet which falls quickly away from the aircraft.

Several types of advanced infra-red seeker systems are in use in anti-aircraft missiles which are designed to recognise the typical characteristics of a decoy flare and ignore it. One such infra-red seeker system is sensitive to the sudden increase in infra-red output intensity in the area of the aircraft exhaust produced when a decoy flare is ignited. When the infra-red seeker system detects a sudden increase in infra-red output intensity it activates countermeasure circuitry for a short time which causes the seeker system to memorise and continue to follow its original trajectory (ie the trajectory calculated by the seeker system from the position and velocity of the aircraft exhaust to lead to impact with the aircraft) ignoring all infra-red sources. The said short time, typically around 0.2 second is chosen so that when the countermeasure circuitry is deactivated a conventional decoy flare will be outside the seeker system's field of view and so the only infra-red source the seeker system recognises is the aircraft exhaust. Thus the missile will continue to track the aircraft exhaust. Another such infra-red seeker system is sensitive to the rate at which the decoy flare separates from the aircraft. When a conventional decoy flare is launched from the aircraft it decelerates rapidly and falls under gravity and so separates rapidly from the aircraft. When the infra-red seeker system detects a second infra-red source it measures the rate of separation of the two sources and memorises and continues to follow its original trajectory. If the rate of separation is above a predetermined level the seeker system will ignore the second source and continue to trace the aircraft exhaust. It takes the seeker system only about 0.2 second to measure the rate of separation. Other advanced infra-red seeker systems use a combination of the two systems described above. Clearly if an infra-red decoy flare is to be effective it must be able to overcome all types of advanced seeker systems.

A known method of overcoming a range of advanced seeker systems is to launch and ignite sequentially a plurality of decoy flares from the aircraft and for the aircraft to simultaneously manoeuvre away from the trajectory of the missile. The principle behind this being that while the seeker system is sequentially detecting and analysing each of the plurality of decoy flares it continues to follow its original memorised trajectory so that by the time the last decoy flare has burnt out the aircraft will have manoeuvred so that the aircraft exhaust tubes face away from the missile and the seeker system no longer recognises the aircraft as its target. A disadvantage of this method is that the plane has to carry a large number of decoy flares which take up a large amount of space in the aircraft. A further disadvantage is that the aircraft has to manoeuvre away from the trajectory of the missile and so is not able to take the most direct route out of a hostile region.

SUMMARY OF THE INVENTION

The present invention seeks to overcome at least some of the aforementioned disadvantages by providing a pyrotechnic decoy flare which can successfully lure incoming missiles with advanced infra-red seeker systems away from an aircraft exhaust.

According to a first aspect of the present invention there is provided an aircraft-launched pyrotechnic decoy flare for luring incoming missiles with advanced seeker-systems away from the aircraft's exhaust, comprising a pellet of a gassy infra-red emitting pyrotechnic composition characterised in that the pellet is configured with a cavity that extends symmetrically alone a fore-and-aft axis of the pellet, the said cavity being vented at the rearward surface of the pellet and a casing which covers the external surface of the pellet forward of the rearward surface of the pellet, the casing being strong enough to remain intact throughout the combustion of the pellet.

In the present invention by employing a decoy flare having a cavity which is vented on its rearward surface the decoy flare can be propelled in the same direction as the aircraft to reduce the rate at which the decoy flare separates from the aircraft exhaust. When the pellet is ignited, combustion spreads almost immediately over the walls of the cavity and the uncovered rearward surface of the pellet. As in conventional pellets this combustion produces a high intensity output of infra-red radiation. As the surface of the cavity combusts hot gaseous products are produced which escape from the cavity through the vent. The rush of hot gaseous products out of the vent in the rearward surface of the pellet gives the flare a forward thrust which propels the flare in a forward direction. Therefore the decoy flare according to the present invention is less likely to be ignored by a seeker system which is sensitive to the rate of separation of the decoy flare from the aircraft exhaust than conventional decoy flares and so is more likely to lure a missile with such a seeker system away from the aircraft exhaust. Furthermore, the decoy flare according to the present invention is more likely to be within the field of view of a seeker system sensitive to a sudden increase in output intensity when the countermeasure circuitry is deactivated and so is more likely to lure a missile with such a seeker system away from the aircraft exhaust.

Clearly the decoy flare according to the present invention can also overcome seeker systems which are sensitive to both the rate of separation of the flare and the aircraft exhaust and a sudden increase in infra-red intensity.

A single decoy flare according to the present invention can overcome different types of advanced seeker systems without relying on the aircraft to manoeuvre away from the trajectory of the incoming missile.

It should be noted that the flare must be designed to have aerodynamic behaviour and be weighted to ensure that when the pellet is ignited at a predetermined time after it is launched from the aircraft the vented surface of the pellet is facing rearwards so that the flare is propelled in the same direction as the aircraft.

Preferably substantially all of the rearward surface of the pellet is not covered by the casing so that the pellet combusts over its entire rearward surface and so produces an infra-red source with a large area which is easily detected by a seeker system.

The decoy flare can have a plug of an infra-red emitting pyrotechnic material covering the rearward surface of the pellet and the vent, the said plug being ignitable on its rearward facing surface. When the plug is ignited on its rearward surface it burns, emitting infra-red radiation, through to the rearward surface of the pellet. The combustion of the plug adjacent to the rearward surface of the pellet ignites the rearward surface of the pellet and the cavity walls. Clearly once the plug has completely combusted it will no longer cover up the vent and so the pellet will combust and be propelled as described above. The composition and thickness of the plug can be altered to alter the time it takes for the plug to burn through and ignite the pellet and thus alter the time between the launch of the flare and the ignition of the pellet. Such a plug is advantageous because it can be used to delay the ignition of the pellet until the rearward surface of the pellet is facing in the correct direction for the flare to be propelled in the same direction as the aircraft.

Preferably the ratio of the surface area of the cavity to the area of the vent is between 10:1 and 60:1. Within this range the rush of gaseous combustion products through the vent will be constricted enough to produce a thrust great enough to accelerate a typical size and mass decoy flare to a velocity which can reduce the separation of the flare and the aircraft to below the critical level. Furthermore, within this range it is unlikely that a build up of pressure in the cavity, caused by the gaseous combustion products being unable to escape, will cause the casing to rupture and the flare to explode.

The pyrotechnic composition will typically have a burning rate which is constant and of the order of several millimeters per second. Therefore the shape of the cavity will determine the way the velocity of the decoy flare varies while the pellet is burning. Preferably the cavity is uniformly cylindrical and the vent is formed by the cylindrical cavity extending to the rearward surface of the pellet. A cylindrical cavity can have a significantly lower surface area than the surface area of the external surface of the pellet, as is preferred. A uniformly cylindrical cavity produces a flare velocity which increases during the combustion of the pellet. This is because as the cavity surface combusts the size of the cavity increases which increases the burning surface area of the cavity walls so that the rate of production of gaseous combustion products increases and the amount of gas rushing out of the vent increases. This effect is countered to some extent because the area of the vent also increases as the surface of the cavity burns.

If the cavity extends from the rear surface of the pellet along the entire axial length of the pellet then it is preferable that an inert cavity closure is located at the forward end of the cavity adjacent to the casing. This prevents combustion from spreading from the cavity along the forward surface of the pellet underneath the casing. If the forward surface of the pellet combusts then it does not contribute to the controlled propulsion of the flare nor the infra-red intensity of the flare and so is wasted. Also if the forward surface of the pellet combusts it may rupture the casing.

Preferably the casing which covers the surface of the pellet is made of a metallic material with a melting point of above 500° C. If the metallic material has a melting point which is lower than this then the heat produced during the combustion of the pellet can melt the casing and the flare may explode. More preferably the metallic material is titanium, alloys of titanium, aluminium or alloys of aluminium. These metallic materials have a high tensile strength so that only a thin layer of material need be used for the casing to remain intact throughout the combustion of the pellet. Furthermore these metallic materials are lightweight and so do not add too much mass to the flare.

Preferably the casing is bonded onto the surface of the pellet to prevent the pellet from slipping out of the casing. Also if the casing fits and is secured tightly over the surface of the pellet it prevents the combustion of the pellet spreading from the rearward surface of the pellet along the surfaces of the pellet covered by the casing. Combustion on the covered surfaces of the pellet may not contribute to the controlled thrust or the infra-red output of the flare and so wastes the pyrotechnic composition. Also combustion on the covered surface may rupture the casing and cause the flare to explode.

Preferably the flare has an aerodynamic collar which is located symmetrically about the fore-and aft axis of the flare, the said collar is fitted slideably to the flare and is extendable out of the rear of the flare, the collar having an annular rim at its forward end which is engageable with an annular rim at the rearward end of the casing. When the pellet is ignited the aerodynamic collar extends rearwardly of the flare due to gas pressure, it slides relative to the casing until the annular rim at the forward end of the collar engages the annular rim at the rearward end of the casing. In its extended position the collar stabilises the flight of the flare.

The preferred gassy infra-red emitting pyrotechnic material comprises an oxidising halogenated polymer and an oxidisable metallic material capable of reacting exothermically with each other on ignition to emit infra-red radiation and an organic binder which binds the oxidising halogenated polymer and the oxidisable metallic material together. The preferred pyrotechnic material may additonally include an oxidising salt, such as Sodium Nitrate or Sodium Perchlorate, to alter the spectrum of infra-red radiation produced when the material combusts.

Such gassy pyrotechnic materials are well known in the art of pyrotechnics. When such a gassy pyrotechnic material is ignited on its surface the surface layer of halogenated polymer oxidises the metallic material emitting infra-red radiation and the relevant metal halide thereby formed is evolved in a gaseous form because of the high temperature of the oxidation reaction (2,000° C.). In this way the composition burns from its surface inwards until all of the composition is combusted. Suitable oxidising halogenated polymers are well known and include polytrifluorochloroethylene and copolymers of trifluorochloroethylene with, for example, vinylidene fluoride. Similarly suitable organic binders are well known and include straight chain chlorinated paraffins, for example Alloprene (TM) and Cereclors (TM) also polyvinylchloride can be used. Suitable oxidisable metallic materials include magnesium, magnesium/aluminium alloy, aluminium, titanium, boron and zirconium.

The oxidising halogenated polymer used in the preferred pyrotechnic composition is preferably a fluorinated polymer because fluorine is a better oxidising agent than any of the other halogens and so fluorinated polymers will react more vigorously with the metallic material. Clearly the faster the rate of reaction is, the faster the rate of evolution of gas is and the higher the intensity of the emitted infra-red radiation is. Preferably there is a high percentage of fluorine in the fluorinated polymer. Typical fluorinated polymers include copolymers of tetrafluoroethylene with perfluoropropylene, homopolymers of perfluoropropylene and copolymers of perfluoropropylene with vinylidene fluoride, homopolymers of hexafluoropropylene and copolymers of hexafluoropropylene with vinylidene fluoride.

More preferably the oxidising fluorinated polymer is PTFE. PTFE is a compound that is very well known in the art of pyrotechnics. PTFE has a high percentage of fluorine in it and is known to react vigorously with the oxidisable metallic materials in the group listed above. Preferably a mixture of granular grade PTFE and lubricant grade PTFE are used in the preferred pyrotechnic composition. By varying the quantities of the different grades of PTFE in the pyrotechnic composition the combustion rate of the preferred pyrotechnical composition can be maximised for a range of altitudes (ie oxygen concentrations).

Preferably the preferred pyrotechnic composition contains between 15% and 50% by weight of PTFE and between 35% and 70% parts by weight of magnesium. The ratio of PTFE to magnesium is not stochiometric, there is an excess of magnesium. Generally there should be an excess of the oxidisable metallic material to the oxidising halogenated polymer because at lower altitudes oxygen present in the air will react with the metallic material. Also if the organic binder is fluorinated this too will react with the metallic material. The ratio of the oxidising halogenated polymer to the oxidisable metallic material should be chosen so that as small amount as possible of either material remains unreacted when the pellet combusts in a variety of oxygen concentrations.

Preferably the organic binder is a fluorinated organic binder, for example the tripolymer of vinylidene fluoride, hexafluoropropylene and tetrafluoroethylene. The advantage of using a fluorinated organic binder is that the binder will join in the reaction because it is also an oxidising agent. More preferably the fluorinated organic binder is a copolymer of vinylidene fluoride and hexafluoropropylene, for example VITON A (TM). VITON A (TM) coats and binds the oxidising halogenated polymer and the oxidisable metallic material very well.

The preferred pyrotechnic composition preferably contains between 1% and 15% by weight of the organic binder. Generally the more organic binder that is used the safer the processing of the preferred composition is. Generally the more binder that is used the easier the preferred composition is to ignite but the combustion rate decreases.

According to a second aspect of the present invention there is provided a pyrotechnic decoy flare comprising;

a first pellet made of a compactly clustered, substantially void free array of discrete pieces made of a gassy infra-red emitting pyrotechnic composition and which is contained within an air-tight container that is designed to rupture and dispense the said discrete pieces when subjected to a predetermined internal pressure generated by the combustion of the gassy pyrotechnic composition, a second pellet according to the first aspect of the present invention, the second pellet being located forward of the first pellet, and launch and initiation means for initiating the second pellet a pre-determined time after initiating the first pellet.

This second aspect of the present invention is more effective than the first aspect against seeker systems which are sensitive to the initial rise in infra-red intensity when a decoy is ignited. This is because the initial rise in infra-red intensity per unit mass of the first pellet is much greater than that produced by a pellet according to the first aspect of the present invention and so is more likely to activate the countermeasure circuitry of such a seeker system.

When the first pellet is ignited combustion spreads rapidly over the surface of the pellet and furthermore rapidly penetrates the pellet along the interfaces between the pieces. The gaseous products from the combustion of the pieces increases the pressure within the container which increases the burning rate of the pieces-to several meters per second so that substantially all of the pieces are ignited in a fraction of a second, ie substantially all the pieces are ignited long before the first ignited pieces burn out. When the pressure inside the container due to the build up of gaseous products reaches the said pre-determined internal pressure, the container ruptures. When the container ruptures the first pellet bursts apart into its constituent pieces because of the evolution of gaseous products at the interfaces between the pieces. The plurality of pieces have a combined surface area which is greater than the surface area of the first pellet and so the pyrotechnic composition which makes up the first pellet is combusted more quickly than if it was in a single homogeneous pellet. Also because of the increase in surface area the pieces are decelerated much more quickly by air resistance. This rapidly reduces the velocity of air flow over the pieces and so rapidly reduces the cooling effect of the air flow causing the particles to combust more quickly. Because the particles combust quickly they give out a high intensity of infra-red radiation for a short period of time.

As stated above the rise in infra-red intensity can cause the seeker system to activate countermeasure circuitry. The launch and initiation means is arranged so that when the countermeasure circuitry is deactivated the second pellet is burning within the field of view of the seeker system and emitting infra-red radiation and the missile is lured towards the second pellet instead of the aircraft exhaust.

A seeker system which is sensitive to the rate of separation of the flare and the aircraft may ignore the first pellet but it will not ignore the second propelled pellet. The decoy flare according to the second aspect of the present invention is also more effective than the first aspect against seeker systems which combine the two seeker systems mentioned above. The decoy flare according to the second aspect of the present invention does not rely on the aircraft to manoeuvre.

Preferably the air-tight container contains both the first and second pellets. More preferably part of the air-tight container is formed from the casing of the second pellet.

Preferably the discrete pieces that make up the first pellet are made of a gassy pyrotechnic composition which has a burning rate of between 5 $cms^{-1}$ and 15 $cms^{-1}$ in air at atmospheric pressure. A pyrotechnic composition with such a high burning rate is preferable because it enables substantially all of the discrete pieces to be ignited in a fraction of a second, so that the first ignited pieces are not close to burning out by the time the last pieces are ignited.

Preferably the predetermined internal pressure under which the container ruptures is that pressure generated by the combustion of the gassy pyrotechnic composition at the earliest time when substantially all of the discrete pieces are ignited. It is advantageous that substantially all the discrete pieces are ignited before the container ruptures, because any unignited pieces cannot be ignited once the first pellet bursts apart and so are wasted. Furthermore it is advantageous that the container ruptures soon after substantially all the pieces have been ignited so that the ignited pieces burn for as long as possible after the pellet bursts apart.

Preferably the first pellet comprises pieces made out of a pyrotechnic composition which has a tacky consistency such that the pieces cohere to form the first pellet under pressure. Pyrotechnic compositions with such a consistency are well known and are more convenient as they remove any need to stick the pieces together.

Alternatively the discrete pieces that make up the first pellet can be stuck together by a cohesive gassy pyrotechnic priming composition to form the pellet. This embodiment is especially advantageous if the discrete pieces are difficult to ignite at high altitudes (ie low oxygen concentrations). On ignition combustion spreads rapidly through the priming composition between the discrete pieces igniting the discrete pieces. Combustion of the priming composition as well as the discrete pieces results in the evolution of gaseous combustion products. The evolution of the gases between the discrete pieces caused the pellet to burst apart into its constituent pieces.

Preferably the discrete pieces that make up the first pellet each have a volume of at least 5 $mm^3$. If the discrete pieces are smaller than this then the time it takes the cloud of burning pieces to burn out may not be long enough for the seeker system to detect the flare.

Preferably the combined surface area of the discrete pieces that make up the first pellet is between 5 and 75 times the surface area of the pellet. Within this range the deceleration of the cloud of pieces is significantly greater than the deceleration of the pellet, thus significantly reducing the cooling air flow over the burning pieces.

The pyrotechnic composition of the first pellet preferably comprises between 15% and 45% by weight of fibrous activated carbon impregnated with a metallic salt and between 55% and 85% by weight of the preferred pyrotechnic composition according to the first aspect of the present invention and between 1% and 6% of the organic binder used in the preferred pyrotechnic composition. The addition of impregnated fibrous activated carbon increases the rate of combustion of the first pellet and thus increases the initial rise in infra-red radiation produced when the first pellet is ignited.

The activity of the fibrous carbon, as measured by its specific heat of wetting with silicone is preferably between $20Jg^{-1}$ (low activity) and $120Jg^{-1}$ (high activity). Preferably the concentration of the metallic salt in the impregnated fibrous activated carbon is such that the impregnated fibrous activated carbon contains between 1% and 20% by weight of the metal. The presence of a metallic salt within this range facilitates ignition and sustains combustion of the carbon within the pyrotechnic composition. Preferably the metallic salt is a copper salt for example copper sulphate, copper nitrate, copper acetate and copper chloride as such salts are easily deposited onto the fibrous carbon and produce high combustion rates in the fibrous carbon in atmospheres depleted of oxygen. Other metal salts can also be used, for example, aluminium and zinc salts.

Preferably the fibrous activated carbon is provided in the form of activated carbon cloth, cloth is preferable because it can be coated with a mixture of the other components of the pyrotechnic composition to give a uniform interface between the fibrous activated carbon and the other components throughout the composition. Loose fibres may be less uniformly spaced throughout the composition and so carbon deficient parts of the composition would combust to give a relatively low infra-red intensity. As an alternative to activated carbon cloth an activated carbon felt could be coated with a mixture of the other components to give a similar result to cloth.

BRIEF DESCRIPTION OF THE DRAWINGS

Embodiments of the present invention will now be described by way of example only with reference to the accompanying drawings in which.

DETAILED DISCUSSION OF PREFERRED EMBODIMENTS

Figure 7:
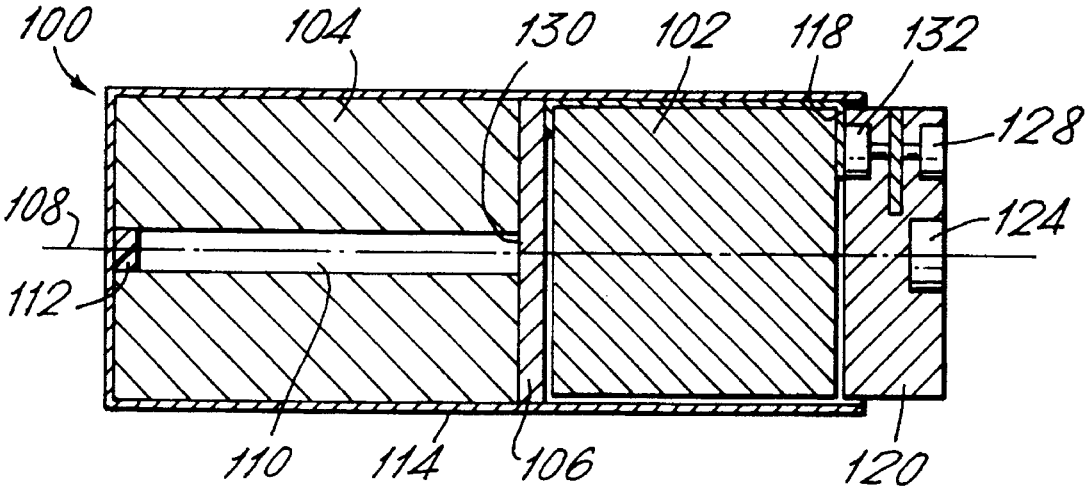
FIG. 7 is a longitudinal section of a second embodiment of a decoy flare according to the second aspect of the present invention.

The preferred pyrotechnic composition A which makes up the pellet 2 and plug 6 in FIG. 1 the pellet 54 in FIG. 4 and the pellet 104 and plug 106 in FIG. 7 is made in the following way. 25 g of VITON A (TM) is dissolved in 250 ml of acetone, the solution is stirred vigorously. More acetone can be added throughout the process to give the mixture a consistancy so that it is easily stirable and to replace acetone which evaporates. 275 g of magnesium, 160 g of granular grade PTFE and 40 g of lubricant grade PTFE are added to the solution, while continuing to stir the mixture vigorously. Then 1200 ml of hexane is added and the magnesium, PTFE, Viton composition (the preferred pyrotechnic composition A) precipitates out of the mixture. The composition A is separated from the hexane/acetone solution by filtration under a vacuum. The composition A is washed three times with 1200 ml of hexane which is filtered off under a vacuum each time. The composition A is then left to dry. When it is dry the composition A is pressed under a pressure of approximately $64\times10^6$Pa to form a solid block.

Figure 1:
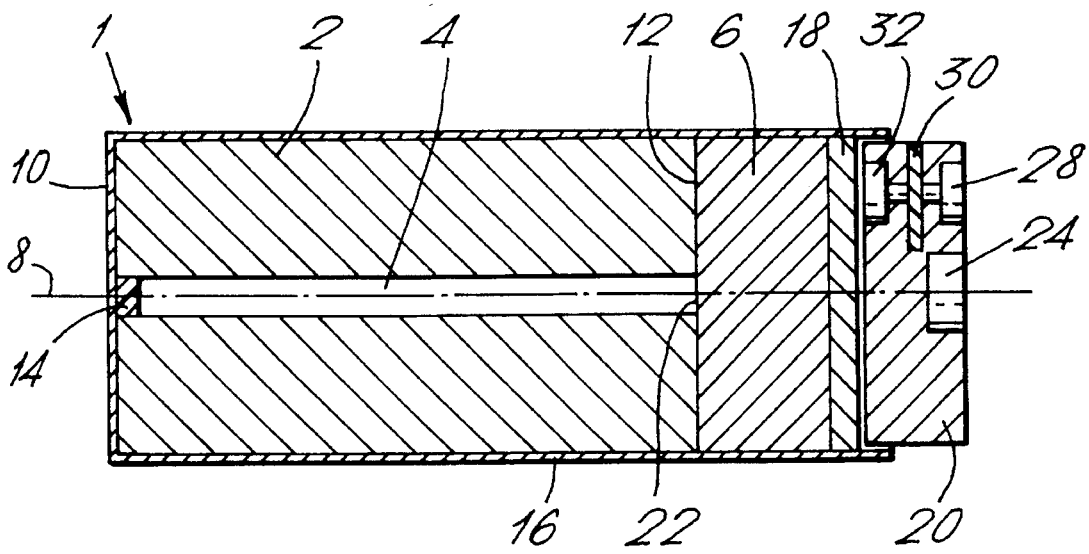
FIG. 1 is a longitudinal section of a decoy flare according to the first aspect of the present invention.

The pyrotechnic composition B which makes up the plug 18 in FIG. 1 is made by the above process but contains 120 g of granular grade PTFE and 80 g of lubricant grade PTFE, in lieu of 160 g and 40 g respectively.

Pyrotechnic composition B has a lower combustion rate than pyrotechnic composition A.

Referring now to FIG. 1 a pellet 2 and a first plug 6 both made of pyrotechnic composition A are made of a single cylindrical block of pyrotechnic composition A which has a diameter of 50 mm and a length of 130 mm. The block of pyrotechnic composition A has a cylindrical cavity 4 located symmetrically about a fore-and-aft axis 8. The cavity 4 extends 115 mm from the forward surface 10 of the pellet 2 to the rearward surface 12 of the pellet 2. An inert cavity closure 14 made of an insulating material which can withstand the high temperatures in the cavity 4 when the pyrotechnic composition A is combusting, for example Tufnol (TM), is fitted tightly into the forward end of the cavity 4. A second cylindrical plug 18 with a diameter of 50 mm and a length of 5 mm and which is made of the slower burning pyrotechnic composition B is pressed onto the rearward surface of the first cylindrical plug 6. The pellet 2, plug 6 and plug 18 are shaped so that they fit tightly into a casing 16. The pellet 2 and plugs 6 and 16 are secured inside the casing 16 using a glue which is resistant to high temperatures, for example Araldite (TM). The casing 16 is made of an aluminium alloy and is approximately 0.5 mm thick but alternatively other high melting point metals or alloys which are light and have a high tensile strength can be used, for example titanium and alloys thereof. The casing 16 is open at its rearward end and extends for a short way rearwardly of the second plug 18. A rear plate 20 is fitted slideably into the rearward end of the casing 16 until it engages the rearward surface of the second plug 18. The rear plate 20 is secured in place by pinching the rear end of the casing 16 around it. The rear plate is made of a low density metal, for example aluminium and has holes drilled in it for the location of a first delay charge 28, a sprung shutter 30, a second delay charge 32 and an expulsion charge 24. The first and second delay charges 28 and 32 are made of a gasless delay fuze material, for example a mixture of boron and bismuth oxide. The shutter 30 which separates the delay charges 28 and 32 is held in place by the internal surface of a launch tube (not shown) from which the decoy flare indicated generally by 1 is launched. The expulsion charge 24 is a propellant charge, for example a gun powder charge.

The decoy flare operates as follows. When an aircraft detects an incoming missile, the aircraft computer sends a signal to initiate the expulsion charge 24 and the first delay charge 28. When expulsion charge 24 is ignited it combusts to produce a large volume of gaseous products which build up behind the flare inside the launch tube (not shown). When the pressure of the gaseous products reaches a pre-determined value a cap (not shown) covering the forward end of the launch tube which restrains the flare inside the launch tube breaks and the flare is propelled out of the launch tube. When the flare exits the launch tube the sprung shutter 30 springs out of the rear cap 20 and the delay charge 28 initiates the delay charge 32. In turn the delay charge 32 ignites the second plug 18. When the second plug 18 ignites combustion spreads rapidly over its rearward surface and the rear plate 20 is blown out of the rear of the casing 16 by the gaseous combustion products thereby produced. The second plug 18 burns on its rearward surface emitting infra-red radiation. Combustion is inhibited from spreading to the other surfaces of the plug 18 because of the tight fit between the casing 16 and the plug 18. The rearward surface of first plug 6 is ignited by the combustion of the second plug 18. The first plug 6 burns on its rearward surface, emitting infra-red radiation until it burns down to the rearward surface of the pellet 2 and ignites the pellet 2. When the pellet 2 is ignited combustion spreads rapidly over the rear surface of the pellet 2 and over the walls of the cavity 4. Combustion is prevented from spreading to other surfaces of the pellet 2 by the casing 16 and the inert plug 14. The Eases produced when the walls of the cavity 4 combust escape from the cavity 4 through the rearward end 22 of the cavity 4 which is no longer covered and so forms the vent. The rush of hot gases through the vent 22 in the rearward surface of the pellet 2 gives the flare a forward thrust which propels the flare in the forward direction. The aerodynamic design of the flare, in particular the position of the centre of gravity of the flare and the time delay between the launch of the flare and the ignition of the pellet 2 in combination with the direction the flare is launched from the aircraft ensures that when the pellet 2 is ignited its forward surface 10 is facing towards the aircraft in the direction of the aircraft's motion.

Figure 2:
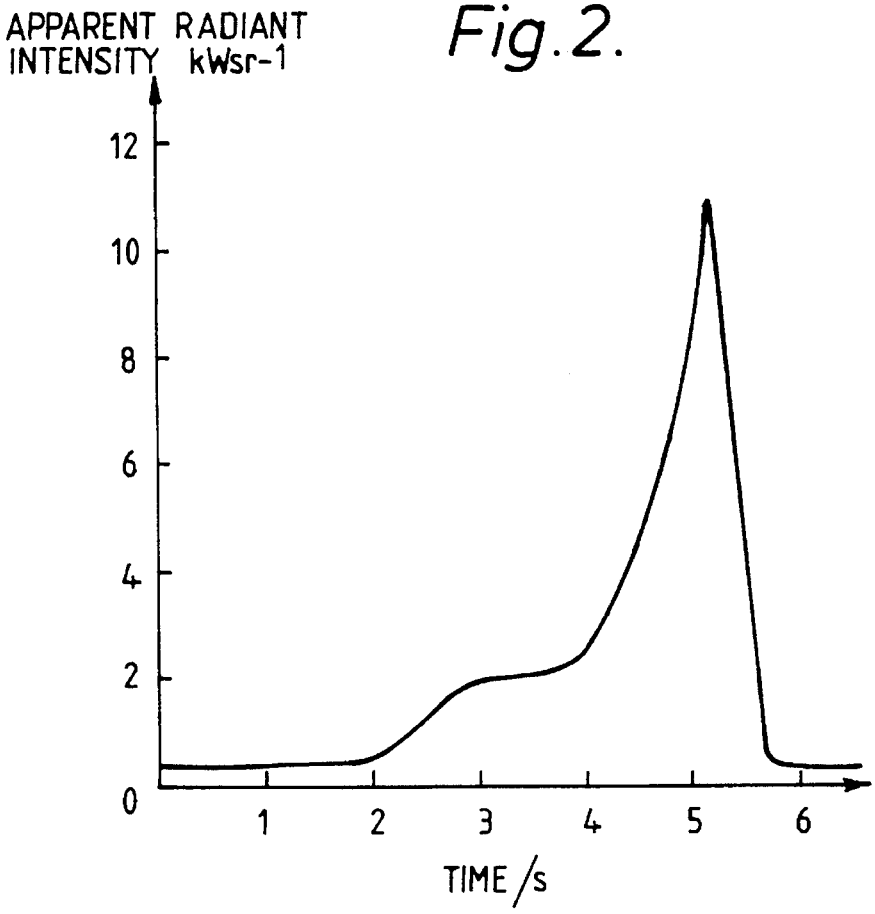
FIG. 2 is a graph of apparent radiant intensity against time when the decoy flare shown in FIG. 1 is launched and ignited at an altitude of 300 m and a velocity of 200 $ms^{-1}$.

Referring now to FIG. 2 which shows how the radiant intensity of the flare varies with time when it combusts. The initial rise in intensity between 2 and 2.5 seconds of up to 2 $kWsr^{-1}$ corresponds to the combustion of the plug 18 which is relatively slow burning and thus produces a relatively low intensity output. The further rise in intensity between 2.5 and 3.5 seconds corresponds to the combustion of the plug 6 which is faster burning and thus gives a higher intensity output. The rapid rise in intensity between 3.5 seconds and 5.5 seconds of up to $11kWsr^{-1}$ corresponds to the combustion of the pellet 2. This rise in intensity is due to the continued increase in surface area of the combusting walls of the cavity as the pellet combusts. Clearly the more of the composition that is burning the greater is the amount of infra-red radiation emitted from the rear of the flare.

Figure 3:
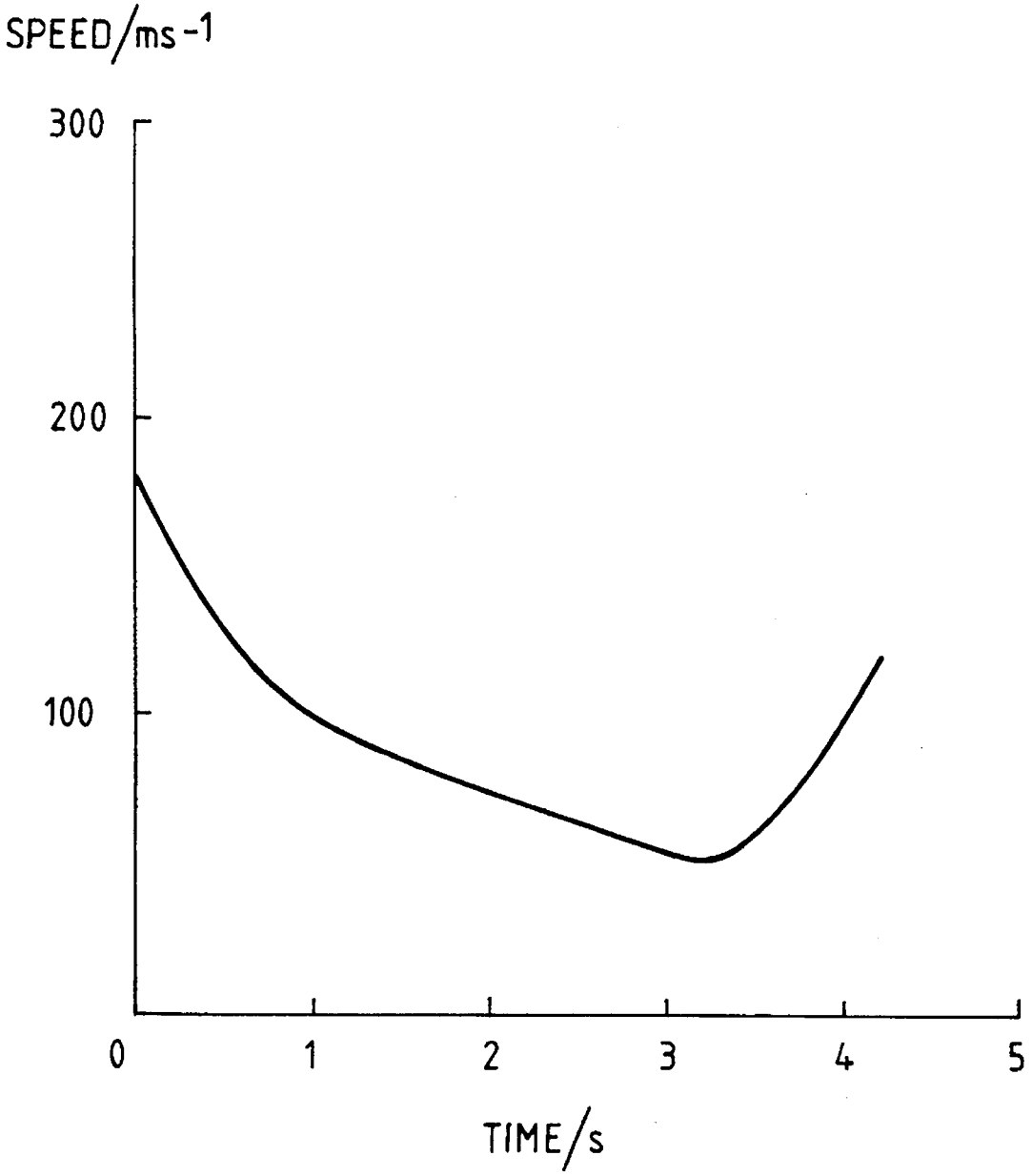
FIG. 3 is a graph of the speed of the decoy flare against time when the decoy flare shown in FIG. 1 is launched and ignited at an altitude of 300 m and a velocity of 200 $ms^{-1}$.

Referring now to FIG. 3 which shows how the speed of the flare 1 varies with time when it combusts. The initial decrease in the speed of the flare from 180 to 50 $ms^{-1}$ between 0 and 3.5 seconds is due to deceleration by air resistance. When the pellet 2 is ignited at around 3 to 3.5 seconds the speed of the flare starts to increase. This is because the flare is propelled by the rush of combustion gases out of the rear of the pellet as described above. FIG. 3 shows that in the first second of combustion of the pellet 2 its velocity increases from 50 $ms^{-1}$ to about 120 $ms^{-1}$.

Figure 4:
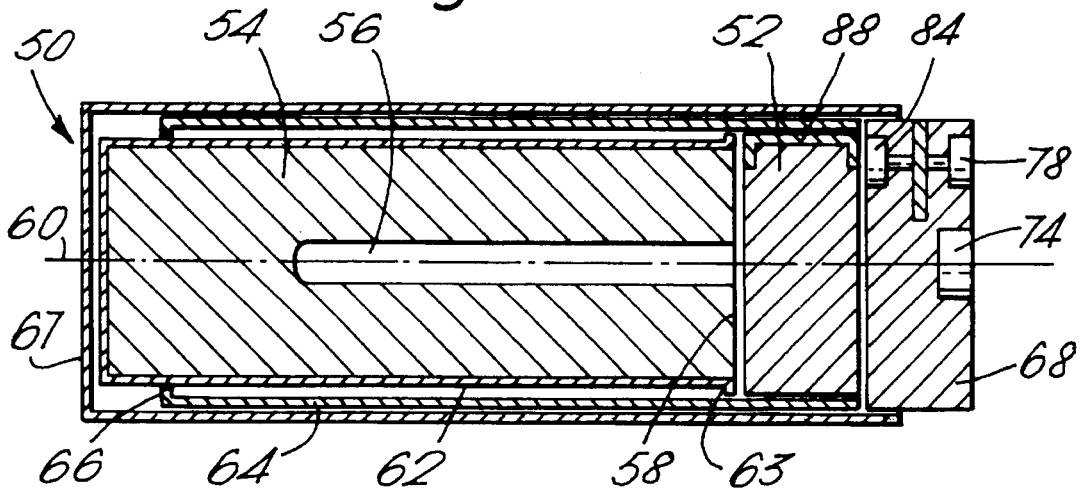
FIG. 4 is a longitudinal section of a decoy flare according to the second aspect of the present invention.

Referring now to FIG. 4, the flare shown therein, indicated generally by 50 comprises a first pellet 52 and a second pellet 54.

The first pellet 52 is made of a pyrotechnic composition C which is made in the following way. 20 g of VITON A (TM) is dissolved in 200 ml acetone to the resulting solution is added 179 g of granular magnesium, 16 g of VITON A (TM) 104 g of granular grade PTFE and 26 g of lubricant grade PTFE. The resulting mixture is stirred to form a suspension which has a spreadable consistancy. The suspension is then coated evenly onto 150 g of commercially available copper treated C-TEX (TM) carbon cloth which can be obtained from SIEBE GORMAN and Company Limited. This is done by spreading the suspension over the cloth with a spatula. The copper treated C-TEX (TM) cloth had been impregnated with approximately 11% by weight of copper. The coated cloth is left to dry for a few hours until the acetone has evaporated off the cloth, leaving a rubbery coating on the cloth.

Figure 10:
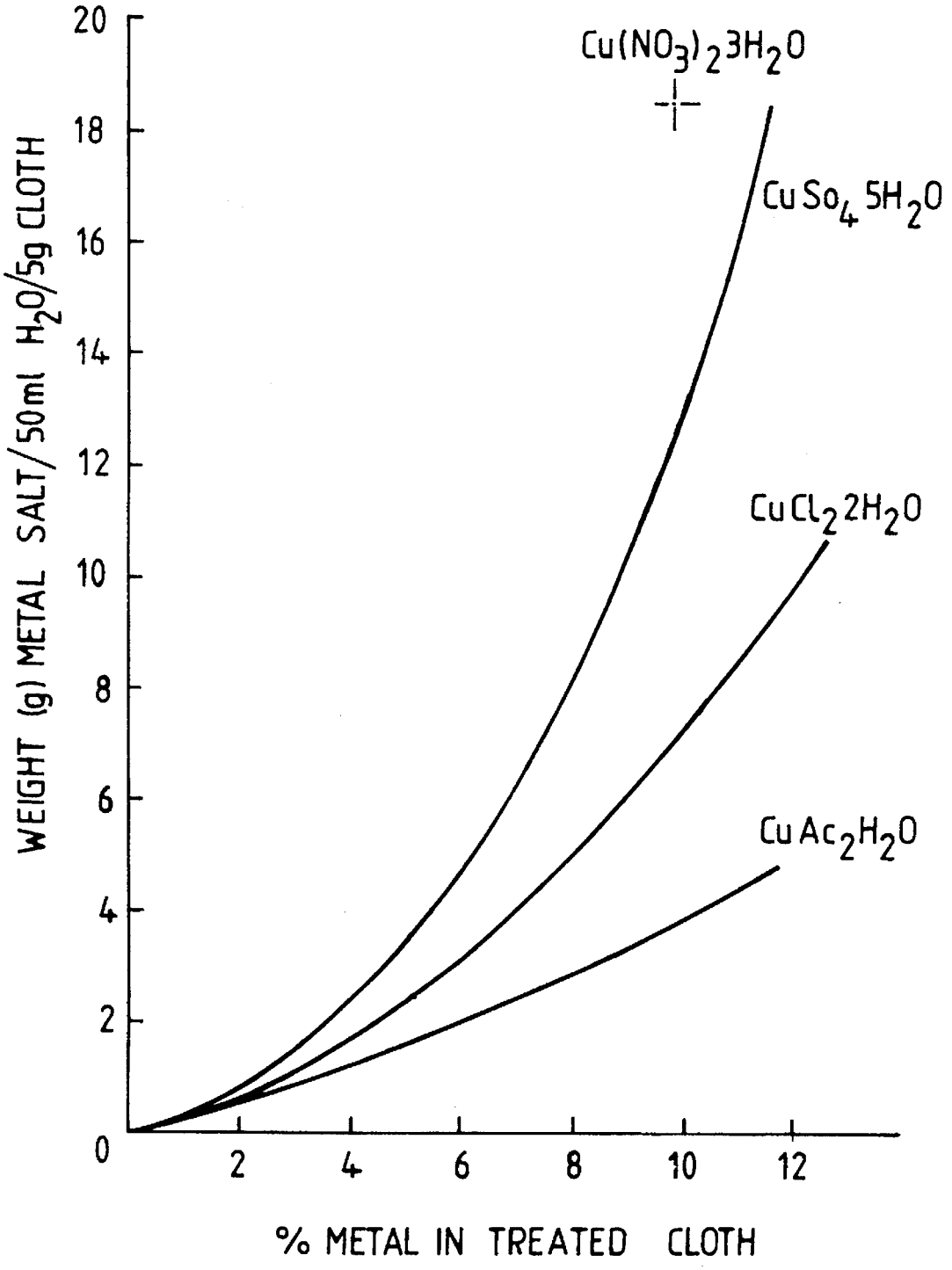
FIG. 10 is a graph of the weight of metal salt per 50 ml of water and per 5 g of charcoal cloth against the percentage of metal in the treated cloth to be used in the preferred composition for the first pellet in the second aspect of the present invention.

Alternatively the impregnated activated carbon cloth can be made by impregnating charcoal cloth, for example untreated C-TEX (TM) carbon cloth, also available from SIEBE GORMAN and Company Limited, with water soluble metallic salts in the following way. Approximately 5 g (25×15 cm) of cloth, dried at 105° C. is immersed in 50 ml aqueous solution of the metallic salt for 2 minutes at 90° C. The cloth is then removed, drained and dried. The approximate amounts of some copper salts per 50 ml water per 5 g of dry fabric necessary to give the required percentages of copper in the fabric are shown in FIG. 10. This process can be scaled up according to the amount of impregnated activated carbon cloth required.

The second pellet 54 is made of a pyrotechnic composition A. The second pellet 54 is cylindrical with a diameter of 45 mm and a length of 120 mm. A cylindrical cavity 56 with a diameter of 8 mm is drilled symmetrically about a fore-and-aft axis 60 of the flare 50, the cavity extending from the rearward surface 58 of the pellet 54 to a depth of 80 mm. The second pellet 54 fits tightly and is glued into an inner casing 62 which is made of aluminium alloy with a thickness of approximately 0.5 mm. The rearward end of the casing 62 has an annular external lip 63. A cylindrical collar 64 with an internal diameter of 51 mm fits slideably over the lip 63 and the casing 62. The collar has an annular lip 66 at its forward end which is engageable with the lip 63 on the casing 62. The collar 64 has a length of 128 mm and in its unextended position extends rearward of the casing 62 for a short distance.

A 20 mm wide strip of the coated cloth of composition C is rolled up tightly to form the first cylindrical pellet 52 which has a diameter of 48 mm. The roll of cloth is prevented from unrolling by pinning the loose end of the roll to the body of the roll. The pellet 52 is located behind the pellet 54, and just touches the pellet 54. The pellet 52 has a strip of primer 88 located on its surface which extends from the second delay charge 84 to the pellet 54. The priming composition is the same as the composition that is spread onto the activated carbon cloth during the process for making composition C.

The pellets 52 and 54, the casing 62 and collar 64 configured as described above are slideably located within a cylindrical outer casing 67 closed at its forward end which is made of aluminium alloy with a thickness of 0.5 mm and has an external diameter of 55 mm. A rear plate 68 identical to rear plate 20 is secured in the open rearward end of the outer casing 67 as described above for rear plate 20.

The decoy flare 50 shown in FIG. 4 operates as follows. When an aircraft detects an incoming missile the aircraft computer sends a signal to initiate the expulsion charge 74 and the first delay charge 78 and the flare is launched out of the rear of the aircraft and initiated as described for the flare 1. When it is launched the rearward end of the flare is pointing in the direction of travel of the aircraft. The second delay charge 84 ignites the primer 88 which ignites the first pellet 52 and the second pellet 54. Combustion gases blow the rear plate 68 and the pellet 52 out of the rear of the outer casing 67. The combustion gases also thrust the collar 64 rearwardly until the internal lip 66 of the collar 64 engages the exterior lip 63 of the casing 62. In its extended position the collar 64 stabilises the flight of the flare 50. The pellet 52 burns quickly in the air emitting high intensity infra-red radiation. Combustion of the pellet 54 spreads rapidly from its rear surface to the walls of the cavity 56. When the pellet 52 leaves the casing 67 and the collar 64 is extended the centre of gravity of the flare is located towards the forward end of the flare so that the flare will rotate in the vertical plane about its centre of gravity. In this way the flare rotates to face in the direction of the aircraft at about the same time as the cavity 56 starts to combust so that the flare is propelled in that direction. The pellet 54 combusts in the same way as the pellet 2 in flare 1.

Figure 5:
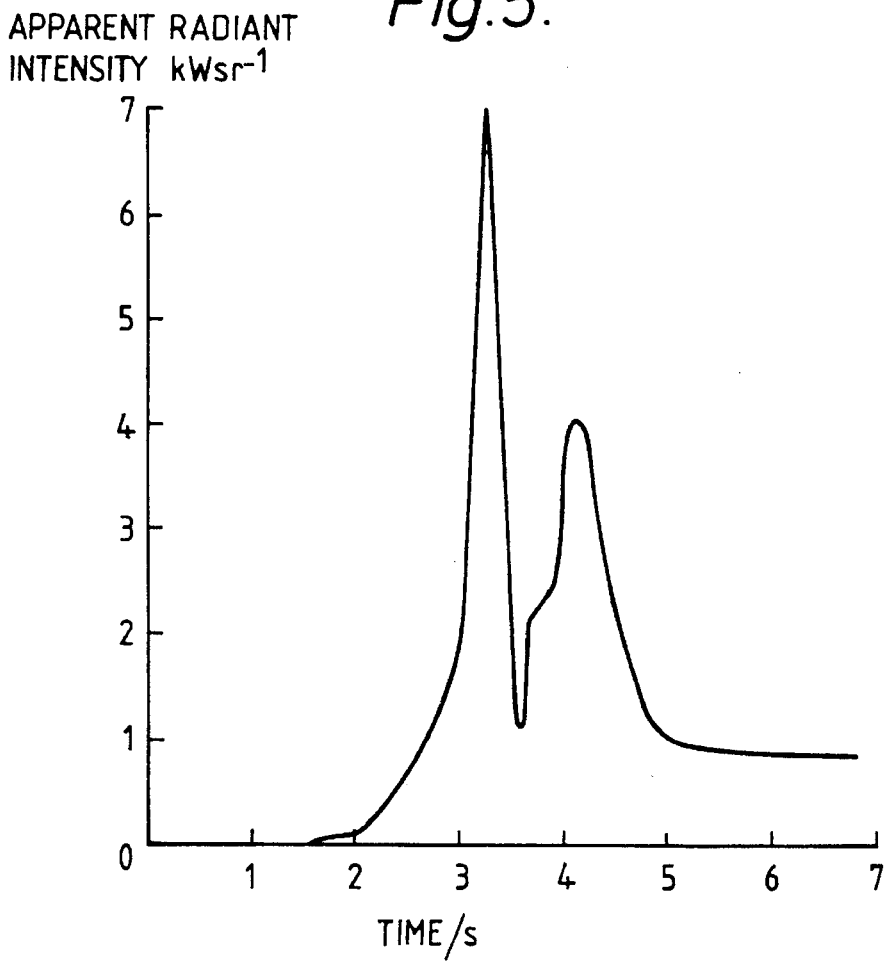
FIG. 5 is a graph of apparent radiant intensity against time when the decoy flare shown in FIG. 4 is launched and ignited at an altitude of 300 m and a velocity of 200 $ms^{-1}$.

Referring now to FIG. 5 which shows how the radiant intensity of the flare 50 varies with time when it combusts. The initial rapid rise in intensity between 2.5 and 3.5 seconds of up to $7kWsr^{-1}$ corresponds to the combustion of the pellet 52. The second lower peak between 3.5 and 5 seconds which rises to about $4kWsr^{-1}$ corresponds to the combustion of the pellet 54. The flare 50 is ideally suited to overcome a seeker system sensitive to the initial rise in intensity produced when a flare is ignited. The combustion of the first pellet 52 produces a very rapid rise in intensity which is highly likely to activate countermeasure circuitry in such a seeker system. The combustion of the second pellet 54 occurs during the period when the countermeasure circuitry in a typical seeker system is most likely to deactive and so the missile can be lured to the second pellet 54 away from the aircraft exhaust.

Figure 6:
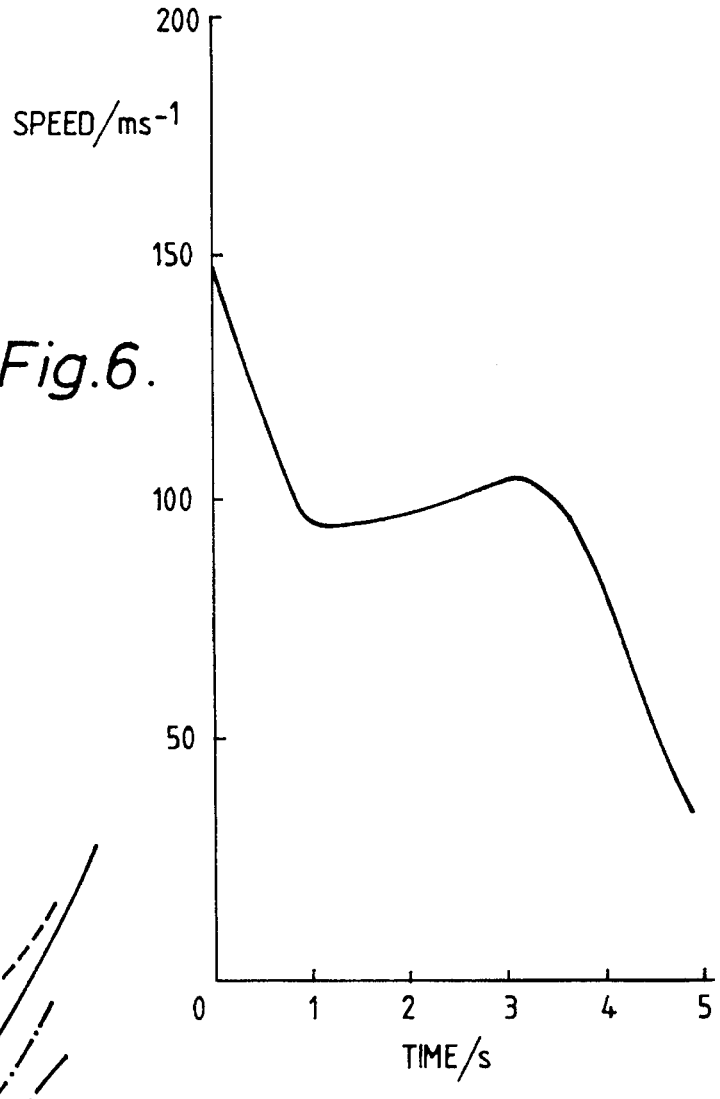
FIG. 6 is a graph of the speed of the decoy flare against time when the decoy flare shown in FIG. 4 is launched and initiated at an altitude of 300 m and a velocity of 200 $ms^{-1}$.

Referring now to FIG. 6 which shows how the speed of a flare of the type 50 varies with time during combustion. The initial decrease in speed from 140 to 100 $ms^{-1}$ between 0 and 1 second is due to deceleration by air resistance. When the pellet 54 is ignited at around 1 second the speed of the flare remains constant at around 100 ms between 1 second and 3 seconds. This is because the flare is propelled by the rush of combustion gases out of the rear of the pellet 54.

It should be noted that the infra-red intensity and the speed of the pellet 54 when it combusts is much less than the infra-red intensity and the speed of the similar pellet 2 shown in FIG. 1) when it combusts under similar circumstances. This is thought to be caused partly because the first pellet 52 combusts very vigorously and may disrupt the second pellet 54 causing it to combust on the surfaces of the pellet 54 covered by the casing 62.

Referring now to FIG. 7, the flare shown therein indicated generally by 100 comprises a first pellet 102 and plug 106 and a second pellet 104.

The first pellet 102 is made of the composition C in the following way. A piece of the coated carbon cloth is cut into squares each with sides of 5 mm, then 140 g of the pieces of cloth are pressed under a pressure of $64\times10^6$ Pa into the cylindrical pellet 102 with a diameter of 48 mm and a length of 48 mm.

The second pellet 104 and plug 106 are made out of a single block of pyrotechnic composition A. The pellet 104 has a length of 115 mm and a diameter of 50 mm and has a cylindrical cavity 110 drilled symmetrically along a fore-and-aft axis 108. The cavity has a diameter of 8 mm and extends along the entire axial length of the pellet 104. The plug 106 has a length of 5 mm. A cavity closure 112 made of Tufnol (TM) is tightly fitted into the forward end of the cavity 110. The pellet 104 and plug 106 are glued into a cylindrical casing 114, closed at its forward end, made of 0.5 mm thick aluminium alloy. The rearward portion of the casing 114 extends rearward of the plug 106. The pellet 102 is located rearward of the plug 106 almost touching the plug 106. A rear plate 120 identical to rear plate 20 is located rearward of the pellet 102 and is secured there by pinching the rearward end of the casing 114 around it. The pellet 102 has a strip of primer 118 located on its surface extending from the second delay charge 132 and the rear plug 106. The priming composition is the same as the composition that is spread onto the activated carbon cloth during the process of making composition C. The decoy flare 100 shown in FIG. 7 operates as follows. When an aircraft detects an incoming missile, the aircraft computer sends a signal to initiate the expulsion charge 124 and the first delay charge 28 and the flare is launched out of the back of the aircraft as described for the flare 1 shown in FIG. 1. When it is launched the rearward end of the flare is pointing in the direction of travel of the aircraft. The delay charge 132 ignites the primer 118 which ignites the first pellet 102 and plug 106. The evolution of gases produced by the combustion of the primer blows the rear plate 120 and the first pellet 102 out of the casing 114. Again the flare 100 is designed so that its centre of gravity is located towards the forward end of the flare and so the flare 100 rotates about its centre of gravity in a similar manner to the flare 50 shown in FIG. 4. Combustion of the first pellet 102 spreads over its surface and the interfaces between the pieces of coated cloth. The evolution of gaseous combustion products at these interfaces caused the pellet 102 to burst apart into its constituent pieces. The pieces of coated cloth are rapidly decelerated because they have a large surface area. The pieces of cloth burn with a high infra-red intensity because the rate of air flow over them is decreased.

Meanwhile the plug 106 combusts and ignites the second pellet 104. The flare 100 is designed so that when the pellet 102 ignites the forward end of the flare has rotated to face in the direction the aircraft is travelling in so that the flare is propelled in that direction. The second pellet 104 combusts to produce hot gaseous products which rush out of the vent 130 as described for pellet 2 of flare 1.

Figure 8:
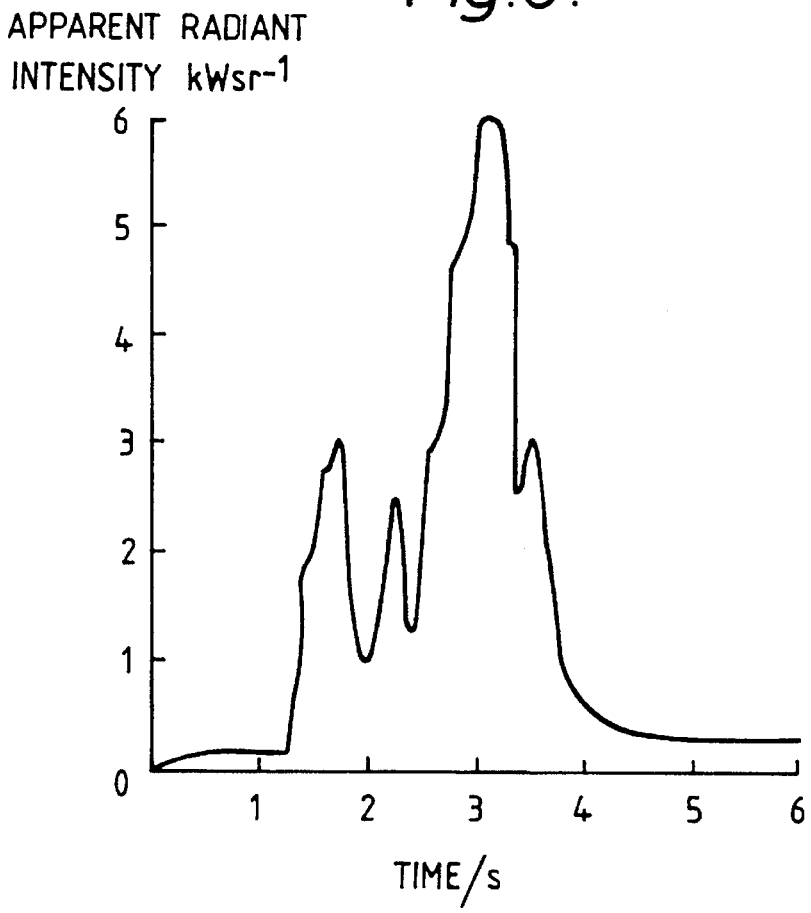
FIG. 8 is a graph of apparent radiant intensity against time when the decoy flare shown in FIG. 7 is launched and ignited at an altitude of 300 m and a velocity of 200 $ms^{-1}$.

Referring now to FIG. 8 which shows how the radiant intensity of the flare 100 varies with time when it combusts. The initial rise in intensity between 1 and 2 seconds of up to $3kWsr^{-1}$ corresponds to the combustion of the first pellet 102. The third peak between 2.5 seconds and 4 seconds which rises to $6kWsr^{-1}$ corresponds to the combustion of the second pellet 104. The intensity of the first pellet 102 was less than expected from results when single pellets similar to the first pellet 102 were ignited under similar conditions.

Figure 9:
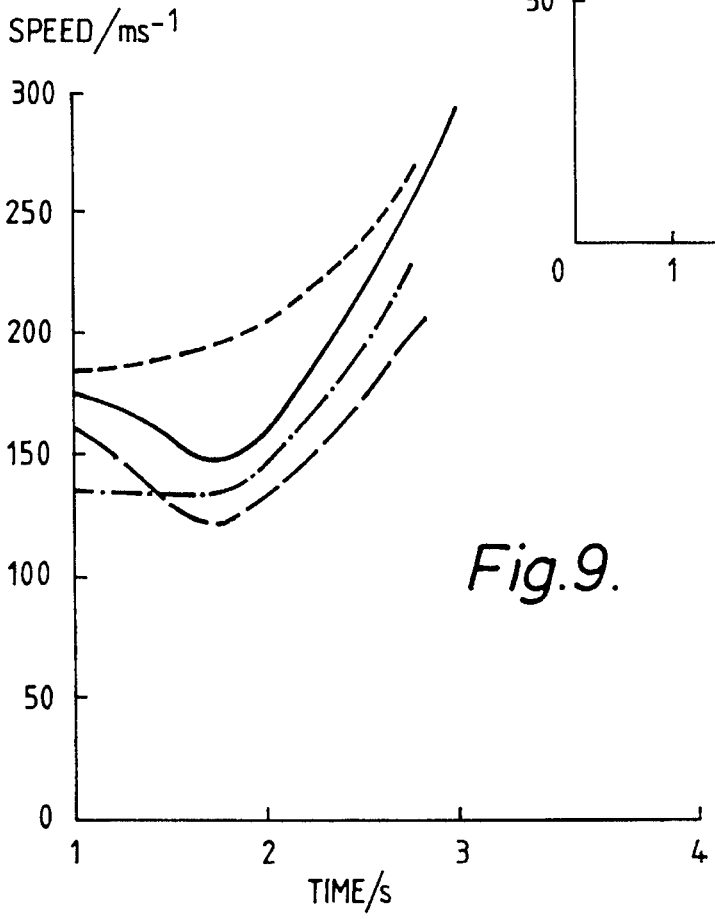
FIG. 9 is a graph of the speed of the decoy flares against time when four decoy flares similar to the one shown in FIG. 6 are launched and ignited at an altitude of 300 m and a velocity of 200 $ms^{-1}$.

Referring now to FIG. 9 which shows how the speeds of four flares similar to flare 100 vary with time on combustion. As can be seen in all four cases the flares have been accelerated rapidly. A flare with a velocity profile shown in FIG. 9 can successfully overcome a seeker system sensitive to the rate of separation of the flare and the aircraft.

We claim:

1. An aircraft-launched pyrotechnic decoy flare for luring incoming missiles away from the aircrafts' exhaust, comprising:

a pellet having a fore-and-aft axis and a rearward surface, said pellet comprising a gassy infra-red emitting pyrotechnic composition, wherein said pellet includes a cavity and a vent, said cavity extending symmetrically along said fore-and-aft axis and said vent providing a means of venting said cavity at said rearward surface of gaseous combustion products produced by combustion of said composition, said vent and combustion products comprising a means for propelling said pellet along said fore-and-aft axis, and a casing for covering the external surface of the pellet forward of said rearward surface, said casing being strong enough to remain intact and for maintaining the external surface of the pellet throughout combustion of said pellet.

2. A pyrotechnic decoy flare according to claim 1 wherein a plug covers said rearward surface and said vent, said plug comprising an infra-red emitting pyrotechnic material.

3. A pyrotechnic decoy flare according to claim 1 wherein the ratio of the surface area of the cavity to the area of the vent is between 10:1 and 60:1.

4. A pyrotechnic decoy flare according to claim 1 wherein the cavity is uniformly cylindrical and the vent is formed by the cylindrical cavity extending to the rearward surface of the pellet.

5. A pyrotechnic decoy flare according to claim 4 wherein the cylindrical cavity extends from the rear surface of the pellet along the entire axial length of the pellet and an inert cavity closure is located at the forward end of the cavity adjacent to the casing.

6. A pyrotechnic decoy flare according to claim 1 wherein the casing is made of a metallic material with a melting point of above 500° C.

7. A pyrotechnic decoy flare according to claim 6 wherein the metallic material is titanium, an alloy of titanium, aluminium or an alloy of aluminium.

8. A pyrotechnic decoy flare according to claim 1 which comprises a means for bonding said casing to the surface of the pellet.

9. A pyrotechnic decoy flare according to claim 1 wherein the flare has an aerodynamic collar which is located symmetrically about the fore-and-aft axis of the flare, the said collar is fitted slideably to the flare and is extendable out of the rear of the flare, the collar having an annular rim at its forward end which is engageable with an annular rim at the rearward end of the casing.

10. A pyrotechnic decoy flare according to claim 1 wherein the gassy infra-red emitting pyrotechnic composition comprises, an oxidising halogenated polymer and an oxidisable metallic material capable of reacting exothermically with each other on ignition to emit infra-red radiation and an organic binder.

11. An aircraft-launched pyrotechnic decoy flare for luring incoming missiles away from the aircraft's exhaust, comprising;

a first pellet which comprises a compactly clustered, substantially void free array of discrete pieces, said discrete pieces comprising a gassy infra-red emitting pyrotechnic composition, an air-tight container for containing said first pellet, a means for causing said air-tight container to rupture and dispense said discrete pieces when subjected to a pre-determined internal pressure generated by combustion of said discrete pieces, a second pellet according to claim 1, said second pellet being located forward of said first pellet, and launch and initiation means for initiating said first pellet a pre-determined time before initiating said second pellet.

12. A pyrotechnic decoy flare according to claim 11 wherein the air-tight container contains both the first and second pellets.

13. A pyrotechnic decoy flare according to claim 11 wherein the discrete pieces that make up the first pellet are made of a gassy pyrotechnic composition which has a burning rate of between 5 $cms^{-1}$ and 15 $cms^{-1}$ in air at atmospheric pressure.

14. A pyrotechnic decoy flare according to claim 11 wherein the pre-determined internal pressure at which the container ruptures is that pressure generated by the combustion of the gassy pyrotechnic composition at the earliest time when substantially all of the discrete pieces of the first pellet are ignited.

15. A pyrotechnic decoy flare according to claim 11 wherein the pieces of the first pellet are made of a pyrotechnic composition which has a tacky consistency such that the discrete pieces cohere to form the first pellet under pressure.

16. A pyrotechnic decoy flare according to claim 11 wherein the discrete pieces that make up the first pellet each have a volume of at least 5 $mm^3$.

17. A pyrotechnic decoy flare according to claim 11 wherein the combined surface area of the discrete pieces that make up the first pellet is between 5 and 75 times the surface area of the pellet.

18. A pyrotechnic decoy flare according to claim 11 wherein the pyrotechnic composition of the first pellet comprises between 15% and 45% by weight of fibrous activated carbon impregnated with a metallic salt, between 55% and 85% by weight of the pyrotechnic composition according to claim 10 and between 1% and 6% of the organic binder.

19. A pyrotechnic decoy flare according to claim 18 wherein the concentration of the metallic salt in the impregnated fibrous activated carbon is such that the fibrous activated carbon containing between 1% and 20% by weight of the metal.

20. A pyrotechnic decoy flare according to claim 19 wherein the metal is copper.

21. A pyrotechnic decoy flare according to claim 18 wherein the fibrous activated carbon is provided in the form of activated carbon cloth.

* * * * *